United States Patent [19]

Walles

[11] Patent Number: 4,462,865

[45] Date of Patent: Jul. 31, 1984

[54] DELIGNIFICATION OF LIGNOCELLULOSIC MATERIALS WITH 2-IMIDAZOLIDINONES AND 2-OXAZOLIDINONES

[75] Inventor: Wilhelm E. Walles, Freeland, Mich.

[73] Assignee: The Dow Chemical Company, Midland, Mich.

[21] Appl. No.: 307,350

[22] Filed: Sep. 30, 1981

[51] Int. Cl.[3] ..... D21C 3/20

[52] U.S. Cl. ..... 162/72; 162/96; 8/189

[58] Field of Search ..... 8/189; 548/317, 229; 162/72

[56] References Cited

U.S. PATENT DOCUMENTS

| | | | |
|---|---|---|---|
| 3,138,610 | 6/1964 | Buc et al. | 162/72 |
| 3,272,689 | 9/1966 | Lenz | 162/72 |
| 3,304,312 | 2/1967 | Beachem | 8/189 |
| 3,876,657 | 4/1975 | Aclony et al. | 548/317 |

*Primary Examiner*—Steve Alvo

[57] ABSTRACT

Lignocellulosic materials are separated into usable lignin and cellulose fractions by contacting said materials with a 2-oxazolidinone (or a 2-imidazolidinone) in weight ratios of at least 1:0.1, respectively, at a temperature between 200° C. and 250° C.

17 Claims, No Drawings

DELIGNIFICATION OF LIGNOCELLULOSIC MATERIALS WITH 2-IMIDAZOLIDINONES AND 2-OXAZOLIDINONES

BACKGROUND OF THE INVENTION

The present invention relates to a process for the delignification of lignocellulose. More particularly, this invention relates to a process for delignification in which the pulping medium is a mixture of water and a 2-oxazolidinone or a 2-imidazolidinone.

There are many known procedures which may be used to delignify wood. Such procedures generally require acidic or alkaline reaction media. An acidic medium, such as that used in the sulfite process, usually causes hydrolysis of alpha-cellulose and further is disadvantageous in that the lignin is obtained as a highly modified sulfonate. An alkaline reaction medium, such as that used in the kraft and soda processes, usually causes some destruction of hemicellulose and converts the lignin to sodium salts of organic acids which possess value mainly as fuel. Additionally, the kraft process is very capital and energy intensive, partially due to the sulfurous wastes it generates. Thus, presently used large-scale delignification processes have known shortcomings.

Heretofore, a method for the delignification of wood using substituted 2-oxazolidinones or 2-imidazolidinones has not been disclosed.

SUMMARY OF THE INVENTION

The present invention is a process for the delignification of lignocellulosic materials using 2-oxazolidinones or 2-imidazolidinones under conditions sufficient to cause a breakdown of the lignocellulosic material to such a degree that it may be separated into a lignin-enriched phase and a cellulose-enriched pulp phase. The cellulose-enriched pulp phase may be used in the manufacture of paper products. The lignin-enriched phase may be used as a chemical feedstock.

DETAILED DESCRIPTION OF THE INVENTION

In the practice of the present invention it is essential to employ a lignocellulosic material and a 2-oxazolidinone or a 2-imidazolidinone. For the purposes of this invention, the term 2-oxazolidinone includes (lower alkyl)-2-oxazolidinones and the term 2-imidazolidinone includes (lower alkyl)-2-imidazolidinones and hydroxy-(lower alkyl)-2-imidazolidinones.

The term lower alkyl is used herein to mean straight- or branched-chain saturated aliphatic radicals which contain from 1 to 5 carbon atoms; examples of the (lower alkyl)-2-oxazolidinones (or 2-imidazolidinones) of this invention are methyl-, ethyl-, n-propyl-, isopropyl-, n-butyl-, sec-butyl-, isobutyl-, t-butyl-, n-pentyl-, isopentyl-, and neopentyl-2-oxazolidinone (or 2-imidazolidinone). Preferred 2-oxazolidinones and 2-imidazolidinones will be substituted with a lower alkyl group and the lower alkyl chain will have 1 or 2 carbon atoms. The most preferred lower alkyl group is ethyl. The term hydroxy-(lower alkyl) is used herein to refer to lower alkyl groups which bear one or more —OH substituents.

Advantageously, the 2-imidazolidinones and 2-oxazolidinones of this invention are represented by formula I:

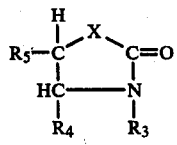

I wherein X is O for 2-oxazolidinone and NH for 2-imidazolidinone, and wherein $R_3$, $R_4$ and $R_5$ are individually H or lower alkyl or in the case of 2-imidazolidinones, $R_3$ may be hydroxy-(lower alkyl). Preferably, $R_3$ and $R_4$ are H and $R_5$ is lower alkyl. For example, a preferred 2-oxazolidinone is 5-ethyl-2-oxazolidinone.

The process of this invention is applicable to lignocellulose generally, including softwoods such as pine and cypresses; hardwoods such as black gum, aspen, oak and fruit woods; and fibers such as those of bagasse, bast and corn stalks. These materials can be used in any convenient form, chips or meal being preferred, and can be previously extracted with organic solvent such as chlorinated hydrocarbons to remove fatty acids and rosins without having a material effect on the pulping procedure of this invention. The hardwood pulp thus obtained is suitable for use as a corrugating medium, and softwood pulp prepared by this procedure is useful for the manufacture of paper.

In the method of the present invention, a 2-oxazolidinone or 2-imidazolidinone is added to a mass of lignocellulosic material in an amount sufficient to break enough of the cross-linking bonds of lignin to allow the depolymerized lignin to be removed from the surrounding cellulosic material. The weight ratio of lignocellulosic material to 2-oxazolidinone (or 2-imidazolidinone) is usually about 1:0.1 or higher. Preferably, the weight ratio will be from about 1:0.3 to about 1:1. The resultant mixture is heated at from about 200° C. to about 250° C. for a time of from about 0.1 to about 5 hours. The preferred temperature range is from about 210° C. to about 235° C. The preferred heating time is from about 0.2 to about 0.5 hours. The time needed to complete the delignification can be shortened by pretreatment of the lignocellulosic material using conventional means such as those which employ organic solvents, such as ethanol-benzene or chlorinated hydrocarbons, e.g., methylene chloride, perchloroethylene, and the like. For an example of pretreatment by said conventional means see U.S. Pat. No. 1,112,359.

In general, less time and/or lower temperatures are required for pulping of hardwood than for pulping of softwood by the procedure of this invention; even with more extensive treatment, softwood pulp thus produced contains a higher percentage of lignin. Hardwood or softwood which has not been extracted will donate fatty acids to the pulping medium; these can precipitate with the lignin or distill during concentration. The presence of fatty acids causes the pH of the solution, originally in the range 9–11, to be reduced. The amount of water which is in the lignocellulosic material, whether dried or not, is sufficient for the delignification of this invention, although additional water may be added if desired. Preferably, additional water is not added to the delignification mixture at the delignification stage of the process.

The treated lignocellulosic material may be subjected to an extractive process to remove the lignin therefrom to yield cellulose fibers. The extracted lignin fraction may then be further treated to yield the usable lignin.

For example, a particular embodiment of this invention involves treatment of wood chips or ground wood with liquid methylene chloride at 25° C. to extract the waxes, fats, rosins, etc. from the wood. The methylene chloride is removed from the wax-containing fraction and recycled. Additional methylene chloride is recovered by blowing dry air through the defatted wood. The defatted wood chips are contacted with a mixture of 5-methyl-2-oxazolidinone and steam in a weight ratio of from 20:1 to 1:10 at 220° C. for a period of 0.1 to 5 hours, followed by cooling with dry air at 25° C. and extraction with liquid methylene chloride to yield cellulosic fibers. The lignin-containing extract stream is then extracted with water to remove the recyclable 5-methyl-2-oxazolidinone. The lignin-containing stream is then devolatilized to yield recyclable methylene chloride and a solvent-soluble lignin fraction. Corn waste, such as stalks and cobs, may be treated according to this embodiment with the deletion of the defatting extraction.

The following examples are given to illustrate the invention and should not be construed as limiting its scope.

EXAMPLE 1

In a stirred vessel equipped with a condenser, 80 g of 5-methyl-2-oxazolidinone is added to 10 g of spruce chips. The mixture is heated to 220° C. and is maintained at that temperature for 3 hours. The mixture is cooled, filtered, and the hardwood pieces are rinsed in ethyl alcohol to extract the lignin fraction. The cellulosic product, after pressing, has a Kappa number of 44 (determined using TAPPI standard test T-236 with one modification; the test was performed at room temperature) and a standard viscosity of 5.1 cp (as determined by TAPPI standard test T-230 using the "closed bottle procedure" with glass beads; additionally, the solution of pulp and cupriethylene diamine is filtered through a coarse glass frit prior to filling the viscometer).

EXAMPLE 2

The procedure of Example 1 is repeated except that 2-imidazolidinone is substituted for 5-methyl-2-oxazolidinone, and the chips are not added to the vessel until the 2-imidazolidinone is melted. The cellulosic product has a Kappa number of 41.8 and a standard viscosity of 14.2 cp.

EXAMPLE 3

The procedure of Example 1 is repeated except that 1-(2-hydroxypropyl)-5-methyl-2-imidazolidinone is substituted for 5-methyl-2-oxazolidinone. The cellulosic product is similar to the products of Examples 1 and 2.

What is claimed is:

1. A process for the delignification of lignocellulosic material comprising contacting a lignocellulosic material with a delignifying agent represented by formula I:

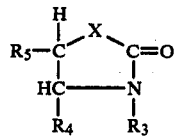

I wherein X is O for 2-oxazolidinone and NH for 2-imidazolidinone, and wherein $R_3$, $R_4$ and $R_5$ are individually H or lower alkyl or in the case of 2-imidazolidinones, $R_3$ may be hydroxy-(lower alkyl); under delignification conditions such that the amount of agent employed is sufficient to delignify the lignocellulosic material to such a degree that the material is separable into a lignin-enriched phase and a cellulosic-enriched pulp phase.

2. The process of claim 1 wherein the temperature of the mixture of the lignocellulosic material and the oxazolidinone or imidazolidinone is from about 200° C. to about 250° C.

3. The process of claim 2 wherein the weight ratio of lignocellulosic material to delignifying agent is about 1:0.1 or greater.

4. The process of claim 2 wherein the delignifying agent is 1-(2-hydroxypropyl)-5-methyl-2-imidazolidinone.

5. The process of claim 1 wherein lower alkyl is ethyl or methyl.

6. The process of claim 5 wherein lower alkyl is ethyl.

7. The method of claim 5 wherein the lignocellulosic material is hardwood.

8. The method of claim 5 wherein the lignocellulosic material is softwood.

9. The method of claim 5 wherein the lignocellulosic material is bagasse or corn waste.

10. The process of claim 6 wherein the delignifying agent is 5-ethyl-2-oxazolidinone.

11. A process for the delignification of lignocellulosic material comprising contacting at least one compound selected from the group consisting of 2-oxazolidinone and lower alkyl derivatives thereof with a lignocellulosic material under conditions sufficient to cause a breakdown of the lignocellulosic material to such a degree that said material may be separated into a lignin-enriched phase and a cellulose-enriched pulp phase.

12. The process of claim 11 wherein the temperature is from about 200° C. to about 250° C.

13. The process of claim 12 wherein the weight ratio of lignocellulosic material to 2-oxazolidinone is about 1:0.1 or higher.

14. The process of claim 11 wherein the 2-oxazolidinone is 5-ethyl-2-oxazolidinone.

15. A process for the delignification of lignocellulosic material comprising contacting at a temperature of from about 200° C. to about 250° C. a lignocellulosic material with at least one compound selected from the group consisting of a 2-oxazolidinone, or a lower alkyl derivative thereof, or a 2-imidazolidinone, or a lower alkyl derivative thereof, or a hydroxy-(lower alkyl)-2-imidazolidinone, under conditions such that the lignocellulosic material may be separated into a lignin-enriched phase and a cellulose-enriched pulp phase, with the proviso that the weight ratio of lignocellulosic material to 2-oxazolidinone or 2-imidazolidinone is about 1:0.1 or higher.

16. A process for the delignification of lignocellulosic material comprising delignifying the lignocellulosic material with a delignifying agent in a weight ratio of lignocellulosic material to delignifying agent of 1:0.1 or higher at a temperature of from about 200° C. to about 250° C. for a period of time sufficient to delignify the lignocellulosic material to such a degree that the material is separable into a lignin-enriched phase and a cellulose-enriched pulp phase, the delignifying agent being selected from the group consisting of 2-oxazolidinone and 2-imidazolidinone compounds represented by the formula:

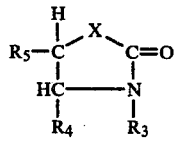
wherein X is O for 2-oxazolidinone and NH for 2-imidazolidinone, and wherein $R_3$, $R_4$ and $R_5$ are individually H or lower alkyl or in the case of 2-imidazolidinones, $R_3$ may be hydroxy-(lower alkyl).
17. The process of claim 11 wherein the 2-oxazolidinone compounds are represented by the formula:
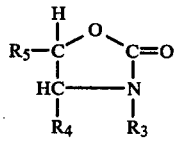
wherein $R_3$, $R_4$ and $R_5$ are individually H or lower alkyl.
* * * * *

UNITED STATES PATENT AND TRADEMARK OFFICE

CERTIFICATE OF CORRECTION

PATENT NO. : 4,462,865

DATED : July 31, 1984

INVENTOR(S) : Wilhelm E. Walles

It is certified that error appears in the above-identified patent and that said Letters Patent are hereby corrected as shown below:

Column 2, line 21, "solvent" should read
-- solvents --

Column 4, line 19, Claim 6, "claim 5" should read
-- claim 2 --

Column 4, line 20, Claim 7, "claim 5" should read
-- claim 2 --

Column 4, line 22, Claim 8, "claim 5" should read
-- claim 2 --

Column 4, line 24, Claim 9, "claim 5" should read
-- claim 2 --

Signed and Sealed this

*Eighth* Day of *January 1985*

[SEAL]

*Attest:*

*Attesting Officer*

GERALD J. MOSSINGHOFF

*Commissioner of Patents and Trademarks*